US008894726B2

(12) United States Patent
Fang et al.

(10) Patent No.: US 8,894,726 B2
(45) Date of Patent: Nov. 25, 2014

(54) FUEL ADDITIVE FOR IMPROVED PERFORMANCE IN FUEL INJECTED ENGINES

(75) Inventors: Xinggao Fang, Midlothian, VA (US); Scott D. Schwab, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 36 days.

(21) Appl. No.: 13/495,471

(22) Filed: Jun. 13, 2012

(65) Prior Publication Data

US 2013/0333649 A1 Dec. 19, 2013

(51) Int. Cl.
*C10L 1/18* (2006.01)

(52) U.S. Cl.
USPC ..... 44/408; 44/331; 44/456

(58) Field of Classification Search
CPC ..... C10L 1/221; C10L 1/224; C10L 1/2383; C10L 10/08; C10L 10/18; C10L 2200/0476; C10L 2230/22; C10L 2270/02; C10L 2270/026
USPC ..... 123/1 A; 44/331, 408, 456
See application file for complete search history.

(56) References Cited

U.S. PATENT DOCUMENTS

| | | | | |
|---|---|---|---|---|
| 2,129,264 | A | 9/1938 | Baxter et al. | |
| 2,568,876 | A * | 9/1951 | White et al. | 508/285 |
| 2,886,423 | A | 5/1959 | Vitalis et al. | |
| 3,015,668 | A | 1/1962 | John | |
| 3,027,246 | A | 3/1962 | Bartlett | |
| 3,092,474 | A | 6/1963 | Ebner | |
| 3,198,613 | A | 8/1965 | Udelhofen | |
| 3,468,640 | A | 9/1969 | Barusch et al. | |
| 3,778,371 | A | 12/1973 | Malec | |
| 4,056,531 | A | 11/1977 | Malec | |
| 4,067,698 | A * | 1/1978 | Steckel | 44/386 |
| 4,171,959 | A | 10/1979 | Vartanian | |
| 4,253,980 | A | 3/1981 | Hammond et al. | |
| 4,326,973 | A | 4/1982 | Hammond et al. | |
| 4,338,206 | A | 7/1982 | Hammond et al. | |
| 4,482,357 | A | 11/1984 | Hanlon | |
| 4,787,916 | A | 11/1988 | Feldman | |
| 4,947,093 | A | 8/1990 | Dunstan et al. | |
| 5,254,138 | A | 10/1993 | Kurek | |
| 5,575,823 | A | 11/1996 | Wallace et al. | |
| 5,752,989 | A | 5/1998 | Henly et al. | |
| 7,297,675 | B2 | 11/2007 | Allef et al. | |
| 7,906,470 | B2 | 3/2011 | Stevenson | |
| 7,947,093 | B2 | 5/2011 | Barton et al. | |
| 7,951,211 | B2 | 5/2011 | Barton et al. | |
| 2003/0131527 | A1 | 7/2003 | Colucci et al. | |
| 2004/0029766 | A1 * | 2/2004 | Frick et al. | 510/499 |
| 2004/0167040 | A1 | 8/2004 | Dahlmann et al. | |
| 2008/0113890 | A1 | 5/2008 | Moreton et al. | |
| 2008/0307698 | A1 * | 12/2008 | Barton et al. | 44/321 |
| 2010/0037513 | A1 | 2/2010 | Petrucci et al. | |
| 2011/0185626 | A1 | 8/2011 | Barton et al. | |
| 2011/0258917 | A1 | 10/2011 | Castro et al. | |
| 2012/0010112 | A1 | 1/2012 | Grabarse et al. | |
| 2012/0138004 | A1 | 6/2012 | Stevenson et al. | |
| 2012/0291339 | A1 | 11/2012 | Martin et al. | |
| 2013/0031828 | A1 | 2/2013 | Reid et al. | |
| 2013/0220255 | A1 | 8/2013 | Fang | |

FOREIGN PATENT DOCUMENTS

| | | | |
|---|---|---|---|
| EP | 0293192 | B1 | 11/1991 |
| EP | 2033945 | A1 | 3/2009 |
| GB | 842728 | A | 7/1960 |
| WO | 2011095819 | A1 | 8/2011 |
| WO | 2011110860 | A1 | 9/2011 |
| WO | 2011149799 | A1 | 12/2011 |
| WO | 2013017889 | A1 | 2/2013 |

OTHER PUBLICATIONS

The Lubrizol Corporation Article: "The CEC DW10 Diesel Fuel Injector Fouling Test" published on 2010. Web Page Link: http://www.lubrizol.com/9040Zer0/DW10TechBulletin.pdf PDF File Attached: "DW10TechBulletin.pdf".*

* cited by examiner

*Primary Examiner* — Cephia D Toomer
(74) *Attorney, Agent, or Firm* — Luedeka Neely Group, P.C.

(57) ABSTRACT

A fuel composition for a fuel injected diesel engine, a method for improving performance of fuel injectors and a method for cleaning fuel injectors for a diesel engine. The fuel composition includes a major amount of fuel and a minor effective amount of a reaction product of (i) a hydrocarbyl substituted compound containing at least one tertiary amino group and (ii) a halogen substituted $C_2$-$C_8$ carboxylic acid, ester, amide, or salt thereof, wherein the reaction product as made is substantially devoid of free anion species.

23 Claims, No Drawings

FUEL ADDITIVE FOR IMPROVED PERFORMANCE IN FUEL INJECTED ENGINES

TECHNICAL FIELD

The disclosure is directed to fuel additives and to additive and additive concentrates that include the additive that are useful for improving the performance of fuel injected engines. In particular the disclosure is directed to a fuel additive that is effective to enhance the performance of fuel injectors for diesel engines.

BACKGROUND AND SUMMARY

It has long been desired to maximize fuel economy, power and driveability in diesel fuel powered vehicles while enhancing acceleration, reducing emissions, and preventing hesitation. While it is known to enhance gasoline powered engine performance by employing dispersants to keep valves and fuel injectors clean in port fuel injection engines, such gasoline dispersants are not necessarily effective fuel injected diesel engines. The reasons for this unpredictability lie in the many differences between the fuel compositions that are suitable for such engines.

Additionally, new engine technologies require more effective additives to keep the engines running smoothly. Additives are required to keep the fuel injectors clean or clean up fouled injectors for spark and compression type engines. Engines are also being designed to run on alternative renewable fuels. Such renewal fuels may include fatty acid esters and other biofuels which are known to cause deposit formation in the fuel supply systems for the engines. Such deposits may reduce or completely bock fuel flow, leading to undesirable engine performance.

Some additives, such as quaternary ammonium salts that have cations and anions bonded through ionic bonding, have been used in fuels but may have reduced solubility in the fuels and may form deposits in the fuels under certain conditions of fuel storage or engine operation. Also, such quaternary ammonium salts may not be effective for use in fuels containing components derived from renewable sources. Accordingly, there continues to be a need for fuel additives that are effective in cleaning up fuel injector or supply systems and maintaining the fuel injectors operating at their peak efficiency.

Also, low sulfur diesel fuels and ultra low sulfur diesel fuels are now common in the marketplace for such engines. A "low sulfur" diesel fuel means a fuel having a sulfur content of 50 ppm by weight or less based on a total weight of the fuel. An "ultra low sulfur" diesel fuel (ULSD) means a fuel having a sulfur content of 15 ppm by weight or less based on a total weight of the fuel. Low sulfur diesel fuels tend to form more deposits in diesel engines than conventional fuels, for example, because of the need for additional friction modifiers and/or corrosion inhibitors in the low sulfur diesel fuels.

In accordance with the disclosure, exemplary embodiments provide a diesel fuel composition for an internal combustion engine comprising, a method for improving performance of fuel injectors, and a method for cleaning fuel injectors for an internal combustion engine. The fuel composition includes a major amount of fuel and a minor effective amount of a reaction product of (i) a hydrocarbyl substituted compound containing at least one tertiary amino group and (ii) at least on halogen substituted $C_2$-$C_8$ carboxylic acid, ester, amide, or salt thereof, wherein the reaction product as made is substantially devoid of free anion species.

Another embodiment of the disclosure provides a method of improving the injector performance of a fuel injected diesel engine. The method includes operating the engine on a fuel composition comprising a major amount of fuel and from about 5 to about 200 ppm by weight based on a total weight of the fuel of a reaction product of (i) a hydrocarbyl substituted compound containing at least one tertiary amino group and (ii) at least one halogen substituted $C_2$-$C_8$ carboxylic acid, ester, amide, or salt thereof, wherein the reaction product as made is substantially devoid of free anion species. The reaction product present in the fuel is effective to improve the injector performance of the engine by at least about 80% when measured according to a CEC F98-08 DW10 test.

A further embodiment of the disclosure provides a method of operating a fuel injected diesel engine. The method includes combusting in the engine a fuel composition comprising a major amount of fuel and from about 5 to about 500 ppm by weight based on a total weight of the fuel of a reaction product of (i) a hydrocarbyl substituted compound containing at least one tertiary amino group and (ii) at least one halogen substituted $C_2$-$C_8$ carboxylic acid, ester, amide, or salt thereof, wherein the reaction product as made is substantially devoid of free anion species.

Another embodiment of the disclosure provides an additive concentrate for a fuel for use in an injected diesel fuel engine. The additive concentrate includes a reaction product of (i) a hydrocarbyl substituted compound containing at least one tertiary amino group and (ii) at least one halogen substituted $C_2$-$C_8$ carboxylic acid, ester, amide, or salt thereof, wherein the reaction product as made is substantially devoid of free anion species; and at least one component selected from the group consisting of diluents, compatibilizers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, and cyclomatic manganese tricarbonyl compounds.

An advantage of the fuel additive described herein is that the additive may not only reduce the amount of deposits forming on fuel injectors, but the additive may also be effective to clean up dirty fuel injectors sufficient to provide improved power recovery to the engine.

Additional embodiments and advantages of the disclosure will be set forth in part in the detailed description which follows, and/or can be learned by practice of the disclosure. It is to be understood that both the foregoing general description and the following detailed description are exemplary and explanatory only and are not restrictive of the disclosure, as claimed.

DETAILED DESCRIPTION OF EXEMPLARY EMBODIMENTS

The fuel additive component of the present application may be used in a minor amount in a major amount of fuel and may be added to the fuel directly or added as a component of an additive concentrate to the fuel. A particularly suitable fuel additive component for improving the operation of internal combustion engines may be made by a wide variety of well known reaction techniques with amines or polyamines. For example, such additive component may be made by reacting a tertiary amine of the formula

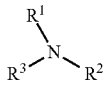

wherein each of $R^1$, $R^2$, and $R^3$ is selected from hydrocarbyl groups containing from 1 to 200 carbon atoms, with a halogen substituted $C_2$-$C_8$ carboxylic acid, ester, amide, or salt thereof. What is generally to be avoided in the reaction is quaternizing agents selected from the group consisting of hydrocarbyl .substituted carboxylates, carbonates, cyclic-carbonates, phenates, epoxides, or mixtures thereof. In one embodiment, the halogen substituted $C_2$-$C_8$ carboxylic acid, ester, amide, or salt thereof may be selected from chloro-, bromo-, fluoro-, and iodo-$C_2$-$C_8$ carboxylic acids, esters, amides, and salts thereof. The salts may be alkali or alkaline earth metal salts selected from sodium, potassium, lithium calcium, and magnesium salts. A particularly useful halogen substituted compound for use in the reaction is the sodium salt of a chloroacetic acid.

As used herein, the term "hydrocarbyl group" or "hydrocarbyl" is used in its ordinary sense, which is well-known to those skilled in the art. Specifically, it refers to a group having a carbon atom directly attached to the remainder of a molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, amino, alkylamino, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as carbonyl, amido, imido, pyridyl, furyl, thienyl, ureyl, and imidazolyl. In general, no more than two, or as a further example, no more than one, non-hydrocarbon substituent will be present for every ten carbon atoms in the hydrocarbyl group; in some embodiments, there will be no non-hydrocarbon substituent in the hydrocarbyl group.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein the term "substantially devoid of free anion species" means that the anions, for the most part are covalently bound to the product such that the reaction product as made does not contain any substantial or detectible amounts of free anions or anions that are ionically bound to the product.

Amine Compound

In one embodiment, a tertiary amine including monoamines and polyamines may be reacted with the halogen substituted acetic acid or derivative thereof Suitable tertiary amine compounds of the formula

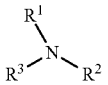

wherein each of $R^1$, $R^2$, and $R^3$ is selected from hydrocarbyl groups containing from 1 to 200 carbon atoms may be used. Each hydrocarbyl group $R^1$ to $R^3$ may independently be linear, branched, substituted, cyclic, saturated, unsaturated, or contain one or more hetero atoms. Suitable hydrocarbyl groups may include, but are not limited to alkyl groups, aryl groups, alkylaryl groups, arylalkyl groups, alkoxy groups, aryloxy groups, amido groups, ester groups, imido groups, and the like. Particularly suitable hydrocarbyl groups may be linear or branched alkyl groups. Some representative examples of amine reactants which can be reacted to yield compounds of this invention are: trimethyl amine, triethyl amine, tri-n-propyl amine, dimethylethyl amine, dimethyl lauryl amine, dimethyl oleyl amine, dimethyl stearyl amine, dimethyl eicosyl amine, dimethyl octadecyl amine, N-methyl piperidine, N,N'-dimethyl piperazine, N-methyl-N'-ethyl piperazine, N-methyl morpholine, N-ethyl morpholine, N-hydroxyethyl morpholine, pyridine, triethanol amine, tri-isopropanol amine, methyl diethanol amine, dimethyl ethanol amine, lauryl diisopropanol amine, stearyl diethanol amine, dioleyl ethanol amine, dimethyl isobutanol amine, methyl diisooctanol amine, dimethyl propenyl amine, dimethyl butenyl amine, dimethyl octenyl amine, ethyl didodecenyl amine, dibutyl eicosenyl amine, triethy lene diamine, hexamethylene tetramine, N,N,N',N'-tetramethylethylenediamine, N,N,N',N'-tetramethylpropylenediamine, N,N,N',N'-tetraethyl-1,3-propanediamine, methyldicyclohexyl amine, 2,6-dimethylpyridine, dimethylcylohexylamine, $C_{10}$-$C_{30}$-alkyl or alkenyl-substituted amidopropyldimethylamine, $C_{12}$-$C_{200}$-alkyl or alkenyl-substituted succinic-carbonyldimethylamine, and the like.

If the amine contains solely primary or secondary amino groups, it is necessary to alkylate at least one of the primary or secondary amino groups to a tertiary amino group prior to the reaction with the halogen substituted $C_2$-$C_8$ carboxylic acid, ester, amide, or salt thereof. In one embodiment, alkylation of primary amines and secondary amines or mixtures with tertiary amines may be exhaustively or partially alkylated to a tertiary amine. It may be necessary to properly account for the hydrogens on the nitrogens and provide base or acid as required (e.g., alkylation up to the tertiary amine requires removal (neutralization) of the hydrogen (proton) from the product of the alkylation). If alkylating agents, such as, alkyl halides or dialkyl sulfates are used, the product of alkylation of a primary or secondary amine is a protonated salt and needs a source of base to free the amine for further reaction.

The halogen substituted $C_2$-$C_8$ carboxylic acid, ester, amide, or salt thereof may be derived from a mono-, di-, or trio-chloro-bromo-, fluoro-, or iodo-carboxylic acid, ester, amide, or salt thereof selected from the group consisting of halogen-substituted acetic acid, propanoic acid, butanoic acid, isopropanoic acid, isobutanoic acid, tert-butanoic acid, pentanoic acid, heptanoic acid, octanoic acid, halo-methyl benzoic acid, and isomers, esters, amides, and salts thereof.

The salts of the carboxylic acids may include the alkali or alkaline earth metal salts, or ammonium salts including, but not limited to the Na, Li, K, Ca, Mg, triethyl ammonium and triethanol ammonium salts of the halogen-substituted carboxylic acids. A particularly suitable component may be selected from chloroacetic acid and sodium chloroacetate. The amount of halogen substituted $C_2$-$C_8$ carboxylic acid, ester, amide, or salt thereof relative to the amount of tertiary amine reactant may range from a molar ratio of about 1:0.1 to about 0.1:1.0.

In some aspects of the present application, the reaction product of the compositions of this disclosure may be used in combination with a fuel soluble carrier. Such carriers may be of various types, such as liquids or solids, e.g., waxes. Examples of liquid carriers include, but are not limited to, mineral oil and oxygenates, such as liquid polyalkoxylated ethers (also known as polyalkylene glycols or polyalkylene ethers), liquid polyalkoxylated phenols, liquid polyalkoxylated esters, liquid polyalkoxylated amines, and mixtures thereof. Examples of the oxygenate carriers may be found in U.S. Pat. No. 5,752,989, issued May 19, 1998 to Henly et. al., the description of which carriers is herein incorporated by reference in its entirety. Additional examples of oxygenate carriers include alkyl-substituted aryl polyalkoxylates described in U.S. Patent Publication No. 2003/0131527, published Jul. 17, 2003 to Colucci et. al., the description of which is herein incorporated by reference in its entirety.

In other aspects, the reaction products may not contain a carrier. For example, some compositions of the present disclosure may not contain mineral oil or oxygenates, such as those oxygenates described above.

One or more additional optional compounds may be present in the fuel compositions of the disclosed embodiments. For example, the fuels may contain conventional quantities of cetane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, cyclomatic manganese tricarbonyl compounds, and the like. In some aspects, the compositions described herein may contain about 10 weight percent or less, or in other aspects, about 5 weight percent or less, based on the total weight of the additive concentrate, of one or more of the above additives. Similarly, the fuels may contain suitable amounts of conventional fuel blending components such as methanol, ethanol, dialkyl ethers, and the like.

In some aspects of the disclosed embodiments, organic nitrate ignition accelerators that include aliphatic or cycloaliphatic nitrates in which the aliphatic or cycloaliphatic group is saturated, and that contain up to about 12 carbons may be used. Examples of organic nitrate ignition accelerators that may be used are methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, and the like. Mixtures of such materials may also be used.

Examples of suitable optional metal deactivators useful in the compositions of the present application are disclosed in U.S. Pat. No. 4,482,357 issued Nov. 13, 1984, the disclosure of which is herein incorporated by reference in its entirety. Such metal deactivators include, for example, salicylidene-o-aminophenol, disalicylidene ethylenediamine, disalicylidene propylenediamine, and N,N'-disalicylidene-1,2-diaminopropane.

Suitable optional cyclomatic manganese tricarbonyl compounds which may be employed in the compositions of the present application include, for example, cyclopentadienyl manganese tricarbonyl, methylcyclopentadienyl manganese tricarbonyl, indenyl manganese tricarbonyl, and ethylcyclopentadienyl manganese tricarbonyl. Yet other examples of suitable cyclomatic manganese tricarbonyl compounds are disclosed in U.S. Pat. No. 5,575,823, issued Nov. 19, 1996, and U.S. Pat. No. 3,015,668, issued Jan. 2, 1962, both of which disclosures are herein incorporated by reference in their entirety.

Other commercially available detergents may be used in combination with the reaction products described herein. Such detergents include but are not limited to succinimides, Mannich base detergents, quaternary ammonium detergents, bis-aminotriazole detergents as generally described in U.S. patent application Ser. No. 13/450,638, and a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697.

When formulating the fuel compositions of this application, the additives may be employed in amounts sufficient to reduce or inhibit deposit formation in a fuel system or combustion chamber of an engine and/or crankcase. In some aspects, the fuels may contain minor amounts of the above described reaction product that controls or reduces the formation of engine deposits, for example injector deposits in diesel engines. For example, the diesel fuels of this application may contain, on an active ingredient basis, an amount of the reaction product in the range of about 5 mg to about 200 mg of reaction product per Kg of fuel, such as in the range of about 10 mg to about 150 mg of per Kg of fuel or in the range of from about 30 mg to about 100 mg of the reaction product per Kg of fuel. In aspects, where a carrier is employed, the fuel compositions may contain, on an active ingredients basis, an amount of the carrier in the range of about 1 mg to about 100 mg of carrier per Kg of fuel, such as about 5 mg to about 50 mg of carrier per Kg of fuel. The active ingredient basis excludes the weight of (i) unreacted components associated with and remaining in the product as produced and used, and (ii) solvent(s), if any, used in the manufacture of the product either during or after its formation but before addition of a carrier, if a carrier is employed.

The additives of the present application, including the reaction product described above, and optional additives used in formulating the fuels of this invention may be blended into the base diesel fuel individually or in various sub-combinations. In some embodiments, the additive components of the present application may be blended into the diesel fuel concurrently using an additive concentrate, as this takes advantage of the mutual compatibility and convenience afforded by the combination of ingredients when in the form of an additive concentrate. Also, use of a concentrate may reduce blending time and lessen the possibility of blending errors.

The fuels of the present application may be applicable to the operation of diesel engine. The engine include both stationary engines (e.g., engines used in electrical power generation installations, in pumping stations, etc.) and ambulatory engines (e.g., engines used as prime movers in automobiles, trucks, road-grading equipment, military vehicles, etc.). For example, the fuels may include any and all middle distillate fuels, diesel fuels, biorenewable fuels, biodiesel fuel, gas-to-liquid (GTL) fuels, jet fuel, alcohols, ethers, kerosene, low sulfur fuels, synthetic fuels, such as Fischer-Tropsch fuels, liquid petroleum gas, bunker oils, coal to liquid (CTL) fuels, biomass to liquid (BTL) fuels, high asphaltene fuels, fuels derived from coal (natural, cleaned, and petcoke), genetically engineered biofuels and crops and extracts therefrom, and natural gas. "Biorenewable fuels" as used herein is understood to mean any fuel which is derived from resources other than petroleum. Such resources include, but are not limited to, corn, maize, soybeans and other crops; grasses, such as switchgrass, miscanthus, and hybrid grasses; algae, seaweed, vegetable oils; natural fats; and mixtures thereof. In an aspect, the biorenewable fuel can comprise monohydroxy alcohols, such as those comprising from 1 to about 5 carbon atoms. Non-limiting examples of suitable monohydroxy alcohols include methanol, ethanol, propanol, n-butanol, isobutanol, t-butyl alcohol, amyl alcohol, and isoamyl alcohol.

Diesel fuels that may be used include low sulfur diesel fuels and ultra low sulfur diesel fuels. A "low sulfur" diesel fuel means a fuel having a sulfur content of 50 ppm by weight or less based on a total weight of the fuel. An "ultra low sulfur" diesel fuel (ULSD) means a fuel having a sulfur content of 15 ppm by weight or less based on a total weight of the fuel.

Accordingly, aspects of the present application are directed to methods for reducing the amount of injector deposits of engines having at least one combustion chamber and one or more direct fuel injectors in fluid connection with the combustion chamber. In another aspect, the reaction products described herein may be combined with succinimide detergents, derivatives of succinimide detergents, and/or quaternary ammonium salts having one or more polyolefin groups; such as quaternary ammonium salts of polymono-olefins, polyhydrocarbyl succinimides; polyhydrocarbyl Mannich compounds: polyhydrocarbyl amides and esters. The foregoing quaternary ammonium salts may be disclosed for example in U.S Pat. Nos. 3,468,640; 3,778,371; 4,056,531; 4171,959; 4,253,980; 4,326,973; 4,338,206; 4,787,916; 5,254,138: 7,906,470; 7,947,093; 7,951,211; U.S. Publication No. 2008/0113890; European Patent application Nos. EP 0293192; EP 2033945; and PCT Application No. WO 2001/110860.

In some aspects, the methods comprise injecting a hydrocarbon-based compression ignition fuel comprising the reaction product of the present disclosure through the injectors of the diesel engine into the combustion chamber, and igniting the compression ignition fuel. In some aspects, the method may also comprise mixing into the diesel fuel at least one of the optional additional ingredients described above.

The fuel compositions described herein are suitable for both direct and indirect injected diesel engines. The directed injected diesel engines include high pressure common rail directed injected engines.

In one embodiment, the diesel fuels of the present application may be essentially free, such as devoid, of conventional succinimide dispersant compounds. In another embodiment, the fuel is essentially free of quaternary ammonium salts of a hydrocarbyl succinimide or quaternary ammonium salts of a hydrocarbyl Mannich. The term. "essentially free" is defined for purposes of this application to be concentrations having substantially no measurable effect on injector cleanliness or deposit formation.

EXAMPLES

The following examples are illustrative of exemplary embodiments of the disclosure. In these examples as well as elsewhere in this application, all parts and percentages are by weight unless otherwise indicated. It is intended that these examples are being presented for the purpose of illustration only and are not intended to limit the scope of the invention disclosed herein.

Comparative Example 1

An additive was produced from the reaction of a 950 number average molecular weight polyisobutylene succinic anhydride (PIBSA) with tetraethylenepentamine (TEPA) in a molar ratio of PIBSA/TEPA=1/1. A modified procedure of U.S. Pat. No. 5,752,989 was used. PIBSA (551 g) was diluted in 200 grams of aromatic 150 solvent under nitrogen atmosphere. The mixture was heated to 115° C. TEPA was then added through an addition funnel. The addition funnel was rinsed with additional 50 grams of solvent aromatic 150 solvent. The mixture was heated to 180° C. for about 2 hours under a slow nitrogen sweep. Water was collected in a Dean-Stark trap. The product obtained was a brownish oil.

Comparative Example 2

A detergent additive was made by combining a reaction product of a hydrocarbyl substituted dicarboxylic acid, or anhydride and an aminoguanidine, wherein the reaction product has less than one equivalent of amino triazole group per molecule as generally described in U.S. patent application Ser. Nos. 13/240,233 and 13/454,697 in a weight ratio of 4.8:1 with a commercially available quaternary ammonium salt, namely a bis-hydrogenated tallow dimethylammonium acetate to provide a detergent additive.

Comparative Example 3

A detergent additive was made by combining a compound as made in Comparative Example 1 in a weight ratio of 3:3:1 with a bisaminotriazole detergent as described in U.S. patent application Ser. No. 13/450,638 and a commercially available quaternary ammonium salt, namely a bis-hydrogenated tallow dimethylammonium acetate to provide a detergent additive.

Comparative Example 4

A commercially available polyisobutylene succinimide (PIBSI) quaternary ammonium salt believed to be a quaternary ammonium salt derived from propylene oxide was used in an amount of 125 ppm by weight of the total fuel composition.

Inventive Example 1

A polyisobutylene succinimide (PIBSI) detergent was prepared as in comparative example 1 except that dimethylaminopropyl-amine (DMAPA) was used in place of TEPA. The resulting PIBSI detergent (about 200 g, 78 wt. % in an aromatic solvent) was combined with 17.8 grams of sodium chloroacetate (SCA), 81 grams of deionized water, 58 grams of aromatic solvent, and 76 grams of isopropanol and heated at 80° C. for 2.5 hours, then at 85° C. for 1 hour. The reaction product was extracted with heptanes and the heptanes layer was washed with water five times to remove sodium chloride from the reaction product. Volatiles were removed from the reaction product under reduced pressure to give a salt product that was a brownish oil.

Inventive Example 2

The reaction product was made similar to that of Inventive Example 1, except that the 950 number average molecular weight PIBSA was replaced with 1300 number average molecular weight PIBSA and the reaction mixture was mixed with toluene to remove water by azeotropic distillation and the resulting product was filtered using a diatomaceous earth filter rather than extracted with heptanes in order to remove sodium chloride from the reaction product. Volatiles were removed from the reaction product under reduced pressure to give a salt product that was a brownish oil.

Inventive Example 3

The reaction product was made similar to Inventive Example 2 with the exception that the 1300 number average molecular weight PIBSI was replaced with oleylamido propyl dimethylamine (OD). The reaction product was mixed with an aromatic solvent and 2-ethylhexanol to provide a yellow liquid.

In the following example, an injector deposit test was performed on a diesel engine using an industry standard diesel engine fuel injector test, CEC F-98-08 (DW10) as described below.

Diesel Engine Test Protocol

A DW 10 test that was developed by Coordinating European Council (CEC) was used to demonstrate the propensity of fuels to provoke fuel injector fouling and was also used to demonstrate the ability of certain fuel additives to prevent or control these deposits. Additive evaluations used the protocol of CEC F-98-08 for direct injection, common rail diesel engine nozzle coking tests. An engine dynamometer test stand was used for the installation of the Peugeot DW10 diesel engine for running the injector coking tests. The engine was a 2.0 liter engine having four cylinders. Each combustion chamber had four valves and the fuel injectors were DI piezo injectors have a Euro V classification.

The core protocol procedure consisted of running the engine through a cycle for 8-hours and allowing the engine to soak (engine off) for a prescribed amount of time. The foregoing sequence was repeated four times. At the end of each hour, a power measurement was taken of the engine while the engine was operating at rated conditions. The injector fouling propensity of the fuel was characterized by a difference in observed rated power between the beginning and the end of the test cycle.

Test preparation involved flushing the previous test's fuel from the engine prior to removing the injectors. The test injectors were inspected, cleaned, and reinstalled in the engine. If new injectors were selected, the new injectors were put through a 16-hour break-in cycle. Next, the engine was started using the desired test cycle program. Once the engine was warmed up, power was measured at 4000 RPM and full load to check for full power restoration after cleaning the injectors. If the power measurements were within specification, the test cycle was initiated. The following Table 1 provides a representation of the DW10 coking cycle that was used to evaluate the fuel additives according to the disclosure.

TABLE 1

One hour representation of DW10 coking cycle.

| Step | Duration (minutes) | Engine speed (rpm) | Load (%) | Torque (Nm) | Boost air after Intercooler (° C.) |
|---|---|---|---|---|---|
| 1 | 2 | 1750 | 20 | 62 | 45 |
| 2 | 7 | 3000 | 60 | 173 | 50 |
| 3 | 2 | 1750 | 20 | 62 | 45 |
| 4 | 7 | 3500 | 80 | 212 | 50 |
| 5 | 2 | 1750 | 20 | 62 | 45 |
| 6 | 10 | 4000 | 100 | * | 50 |
| 7 | 2 | 1250 | 10 | 25 | 43 |
| 8 | 7 | 3000 | 100 | * | 50 |
| 9 | 2 | 1250 | 10 | 25 | 43 |
| 10 | 10 | 2000 | 100 | * | 50 |
| 11 | 2 | 1250 | 10 | 25 | 43 |
| 12 | 7 | 4000 | 100 | * | 50 |

Various fuel additives were tested using the foregoing engine test procedure in an ultra low sulfur diesel fuel containing zinc neodecanoate, 2-ethylhexyl nitrate, and a fatty acid ester friction modifier (base fuel). A "dirty-up" phase consisting of base fuel only with no additive was initiated, followed by a "clean-up" phase consisting of base fuel plus 10 percent biodiesel with additive. All runs were made with 8 hour dirty-up and 8 hour clean-up unless indicated otherwise. The percent power recovery was calculated using the power measurement at end of the "dirty-up" phase and the power measurement at end of the "clean-up" phase. The percent power recovery was determined by the following formula $$\text{Percent Power recovery}=(DU-CU)/DU\times 100$$

wherein DU is a percent power loss at the end of a dirty-up phase without the additive, CU is the percent power at the end of a clean-up phase with the fuel additive, and power is measured according to CEC F98-08 DW10 test.

TABLE 2

| Example | Additives and treat rate (ppm by weight) | Power loss % DU | Power loss % CU |
|---|---|---|---|
| 1 | Compound of Comparative Example 1 (180 ppm) | −4.76 | −4.46 |
| 2 | Detergent mixture of Comparative Example 2 (145 ppm) | −3.62 | −1.95 |
| 3 | Detergent mixture of Comparative Example 3 (140 ppm) | −4.09 | −3.67 |
| 4 | Detergent of Comparative Example 4 | −3.67 | −2.4 |
| 5 | Compound of Inventive Example 2 (250 ppm) | −1.18 | 1.31 |
| 6 | Compound of Inventive Example 2 (125 ppm) and 30 ppm detergent made according to U.S. patent application Nos. 13/240,233 and 13/454,697 | −3.61 | −0.39 |
| 7 | Compound of Inventive Example 3 (50 ppm) and 75 ppm detergent made according to U.S. patent application Nos. 13/240,233 and 13/454,697 | −4.6 | −0.05 |

As shown by the foregoing Examples 5-7, a detergent or detergent mixture containing the reaction product described herein provides significant improvement in power loss recovery compared to conventional detergents in diesel fuels (Examples 1-4).

For comparison purposes, the percent flow remaining was also determined in the XUD9 engine test as shown in Table 3. The XUD9 test method is designed to evaluate the capability of a fuel to control the formation of deposits on the injector nozzles of an Indirect Injection diesel engine. Results of tests run according to the XUD9 test method are expressed in terms of the percentage airflow loss at various injector needle lift points. Airflow measurements are accomplished with an airflow rig complying with ISO 4010.

Prior to conducting the test, the injector nozzles are cleaned and checked for airflow at 0.05, 0.1, 0.2, 0.3 and 0.4 mm lift. Nozzles are discarded if the airflow is outside of the range 250 ml/min to 320 ml/min at 0.1 mm lift. The nozzles are assembled into the injector bodies and the opening pressures set to 115±5 bar. A slave set of injectors is also fitted to the engine. The previous test fuel is drained from the system. The engine is run for 25 minutes in order to flush through the fuel system. During this time all the spill-off fuel is discarded and not returned. The engine is then set to test speed and load and all specified parameters checked and adjusted to the test specification. The slave injectors are then replaced with the test units. Air flow is measured before and after the test. An average of 4 injector flows at 0.1 mm lift is used to calculate the percent of fouling. The degree of flow remaining=100–percent of fouling. The results are shown in the following table.

TABLE 3

| Example | Additives and treat rate (ppm by weight) | 0.1 mm lift flow remaining % |
|---|---|---|
| 1 | Compound of Comparative Example 1 (50 ppm) | 46 |
| 2 | Compound of Inventive Example 1 (50 ppm) | 91 |

As shown by the foregoing example, Runs 2, 3, and 4 of Table 2 showed significant power recover upon clean up compared to a convention detergent of Run 1. Likewise, Run 2 of Table 3 showed significant ability to maintain a high flow rate in fuel injectors compared to a conventional fuel detergent of Run 1. It is believed that the disclosed reaction products as described herein may be effective for keeping surfaces of fuel injectors for engines clean and may be used for cleaning up dirty fuel injectors.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A fuel composition for a fuel injected diesel engine comprising: a major amount of fuel and a minor effective amount of a reaction product of (i) a hydrocarbyl substituted compound containing at least one tertiary amino group wherein the hydrocarbyl substituted compound is selected from the group consisting of $C_{10}$-$C_{30}$-alkyl or alkenyl-substituted amidopropyldimethylamines and $C_{12}$-$C_{200}$-alkyl or alkenyl-substituted succinic-carbonyldimethylamines and (ii) a halogen substituted $C_2$-$C_8$ carboxylic acid, ester, amide, or salt thereof, wherein the reaction product as made is substantially free of non-covalently bonded anion species, and wherein the minor effective amount of reaction product is an amount sufficient to improve engine performance.

2. The fuel composition of claim 1, wherein the fuel has a sulfur content of 50 ppm by weight or less.

3. The fuel composition of claim 1, wherein the amines are selected from the group consisting of oleylamidopropyl dimethylamine, and cocoamidopropyl dimethylamine.

4. The fuel composition of claim 1, wherein the hydrocarbyl group of the hydrocarbyl substituted compound is selected from the group consisting of linear, branched, substituted, cyclic, saturated, and unsaturated compounds and compounds containing one or more hetero atoms.

5. The fuel composition of claim 1, wherein the hydrocarbyl groups of the hydrocarbyl substituted compound are selected from alkyl and alkenyl groups.

6. The fuel composition of claim 1, wherein from about 0.1 to about 1.0 moles of (i) are reacted with from about 1.0 to about 0.1 moles of (ii).

7. The fuel composition of claim 1, wherein the halogen substituted $C_2$-$C_8$ carboxylic acid salt comprises sodium chloroacetate.

8. The fuel composition of claim 1, wherein the amount of reaction product in the fuel ranges from about 5 to about 200 ppm by weight based on a total weight of fuel.

9. The fuel composition of claim 1, wherein the amount of reaction product in the fuel ranges from about 10 to about 150 ppm by weight based on a total weight of the fuel.

10. The fuel composition of claim 1, wherein the amount of reaction product in the fuel ranges from about 30 to about 100 ppm by weight based on a total weight of the fuel.

11. The fuel composition of claim 1, wherein the fuel contains bio-diesel components and wherein said improved engine performance comprises engine power restoration by at least about 80% when measured according to a CEC F98-08 DW10 test.

12. The fuel composition of claim 1, wherein the fuel contains bio-diesel components and wherein said improved engine performance comprises engine power restoration by at least about 90% when measured according to a CEC F98-08 DW10 test.

13. The fuel composition of claim 1, wherein the fuel contains bio-diesel components and wherein said improved engine performance comprises engine power restoration by at least about 100% when measured according to a CEC F98-08 DW10 test.

14. A method of improving the injector performance of a fuel injected diesel engine comprising operating the engine on a fuel composition comprising a major amount of fuel containing bio-diesel components and from about 5 to about 200 ppm by weight based on a total weight of the fuel of a reaction product of (i) a hydrocarbyl substituted compound containing at least one tertiary amino group and (ii) a halogen substituted $C_2$-$C_8$ carboxylic acid, ester, amide, or salt thereof, wherein the reaction product as made is substantially free of non-covalently bonded anion species, and, wherein the reaction product present in the fuel improves the injector performance of the engine by at least about 80% when measured according to a CEC F98-08 DW10 test.

15. The method of claim 14, wherein the engine comprises a direct fuel injected diesel engine.

16. The method of claim 14, wherein the halogen substituted $C_2$-$C_8$ carboxylic acid salt comprises sodium chloroacetate.

17. The method of claim 14, wherein the hydrocarbyl group of the hydrocarbyl substituted compound is selected from the group consisting of linear, branched, substituted, cyclic, saturated, and unsaturated compounds and compounds containing one or more hetero atoms.

18. A method of operating a fuel injected diesel engine comprising combusting in the engine a fuel composition comprising a major amount of fuel and from about 5 to about 200 ppm by weight based on a total weight of the fuel of a reaction product of (i) a hydrocarbyl substituted compound containing at least one tertiary amino group wherein the hydrocarbyl substituted compound is selected from the group consisting of $C_{10}$-$C_{30}$-alkyl or alkenyl-substituted amidopropyldimethylamines and $C_{12}$-$C_{200}$alkyl or alkenyl-substituted succinic-carbonyldimethylamines and (ii) a halogen substituted $C_2$-$C_8$ carboxylic acid, ester, amide, or salt thereof, wherein the reaction product as made is substantially free of non-covalently bonded anion species.

19. The method of claim 18, wherein the hydrocarbyl group of the hydrocarbyl substituted compound is selected from the group consisting of linear, branched, substituted, cyclic, saturated, and unsaturated compounds and compounds containing one or more hetero atoms.

20. The method of claim 18, wherein the halogen substituted $C_2$-$C_8$ carboxylic acid salt comprises sodium chloroacetate.

21. An additive concentrate for a fuel for use in a injected fuel diesel engine comprising a reaction product of (i) a hydrocarbyl substituted compound containing at least one tertiary amino group wherein the hydrocarbyl substituted compound is selected from the group consisting of $C_{10}$-$C_{30}$-alkyl or alkenyl-substituted amidopropyldimethylamines and $C_{12}$-$C_{200}$-alkyl or alkenyl-substituted succinic-carbonyldimethylamines and (ii) a halogen substituted $C_2$-$C_8$ carboxylic acid, ester, amide, or salt thereof, wherein the reaction product as made is substantially free of non-covalently bonded anion species; and at least one component selected from the group consisting of diluents, carrier fluids, compatibilizers, cetane improvers, corrosion inhibitors, cold flow improvers (CFPP additive), pour point depressants, solvents, demulsifiers, lubricity additives, friction modifiers, amine stabilizers, combustion improvers, dispersants, antioxidants, heat stabilizers, conductivity improvers, metal deactivators, marker dyes, organic nitrate ignition accelerators, and cyclomatic manganese tricarbonyl compounds.

22. The additive concentrate of claim 21, wherein the hydrocarbyl group of the hydrocarbyl substituted compound is selected from the group consisting of linear, branched, substituted, cyclic, saturated, and unsaturated compounds and compounds containing one or more hetero atoms.

23. The additive concentrate of claim 21, wherein the halogen substituted $C_2$-$C_8$ carboxylic acid salt comprises sodium chloroacetate.

* * * * *